United States Patent [19]

Hufton

[11] 4,343,170

[45] Aug. 10, 1982

[54] APPARATUS FOR EXPANDING TUBULAR MEMBERS

[75] Inventor: Peter F. Hufton, Etwall, England

[73] Assignee: Northern Engineering Industries Limited, Newcastle upon Tyne, England

[21] Appl. No.: 227,361

[22] Filed: Jan. 22, 1981

[30] Foreign Application Priority Data

Feb. 14, 1980 [GB] United Kingdom ..... 8004986

[51] Int. Cl.[3] ..... B21D 22/10

[52] U.S. Cl. ..... 72/61; 29/237; 29/421 R; 72/370

[58] Field of Search ..... 72/61, 62, 370; 29/237, 29/507, 523, 421 R

[56] References Cited

U.S. PATENT DOCUMENTS

| | | | |
|---|---|---|---|
| 2,704,104 | 3/1955 | Mueller | 72/62 X |
| 2,971,556 | 2/1961 | Armstrong et al. | 72/370 X |
| 3,200,628 | 8/1965 | Polkowski | 72/62 |
| 4,022,042 | 5/1977 | Linz | 72/62 |
| 4,152,821 | 5/1979 | Scott | 29/237 X |

FOREIGN PATENT DOCUMENTS

| | | | |
|---|---|---|---|
| 2406400 | 8/1977 | Fed. Rep. of Germany | 72/61 |
| 626787 | 6/1978 | U.S.S.R. | 72/61 |

*Primary Examiner*—Leon Gilden

[57] ABSTRACT

Apparatus for use in expanding tubes into holes in tubeplates including walls of drums and headers especially in boilers in which an annular body of elastomeric material is compressed axially and expands radially to force the tube into close engagement with the wall of the hole. The elastomeric material is supported at its ends by radially expansible supports each made up of pieces sliding on adjacent pieces, the sliding surfaces being forced together by the applied force, the pieces being located on reduced diameter end portions of the body. The invention enables applied pressures of the order of 70,000 psi (4830 bar) to be used to stress the tubeplate beyond its elastic limit without damage to the body caused by extrusion.

9 Claims, 15 Drawing Figures

APPARATUS FOR EXPANDING TUBULAR MEMBERS

BACKGROUND OF THE INVENTION

The invention relates to apparatus for shaping tubular members or joining tubular members to another member, such as a tubeplate by expansion of the tubular member.

By tubeplate is meant any tubeplate as such or the wall of a header, drum or other component to which a tube or tubes are joined.

It has already been proposed in U.S. patent specification No. 4,006,619 to expand a tube by axially compressing an annular body of rubber or other elastomeric material within the tube by mechanically applied force so as to produce radial expansion of the body. In that method the annular body is supported at its ends by respective annular arrays of separate metal segments, with open gaps between them.

In that method, the tube is expanded only outside the tubeplate and the tubeplate is not stressed beyond its elastic limit by the expansion of the body of elastomeric material.

In that proposal, the segments which support the body of elastomeric material at its ends have faces engaging the elastomeric material which are inclined so as to restrict the radial expansion of the elastomeric material adjacent its ends. Furthermore, in that proposal, the body of elastomeric material is required merely to stress only the tube beyond its elastic limit. The tube-plate is not stressed or is only slightly stressed elastically. The tubeplate is not stressed beyond its elastic limit.

As explained in U.S. Pat. No. 4,006,619, a problem arises in that the elastomeric material tends to extrude through the gaps between the segments. In any case, until the material has extruded into the gaps only relatively low pressure can be generated in the material and part of the stroke of the tool which applies the load is effectively wasted.

The presence of such gaps gives rise to several drawbacks among which are the damage to the material as it extrudes into the gaps, which means that the material must be replaced after each expansion or after only one or two expansions; and the gaps cannot be maintained equal so that excessive extrusion can occur at one excessively large gap.

For certain applications it is required to apply relatively high pressure to the tube, in which cases the presence of empty gaps into which the material can flow cannot be tolerated at all.

Where it is required to apply sufficient force to stress the tubeplate beyond its elastic limit and to achieve sufficient residual stress in the tubeplate to ensure adequate holding force on the tube, very high applied pressures have to be used approaching 70,000 pounds per square inch (4830) bar.

Furthermore, tolerances on the tube or on the hole or on both may give rise to an annular clearance between the inner surface of the tube and the outer diameter of the main parts of the tool between which the elastomeric body is compressed as large as 0.10 inch (2.54 millimeters).

The tendency for the elastomeric material to extrude at such pressure is even greater and the supports at the ends of the body must not only be able to prevent such extrusion but must not reduce to any pronounced degree the pressure which the elastomeric body is applying to the tube.

BRIEF SUMMARY OF THE INVENTION

The invention meets such requirements by the provision at each end of the body of an end portion of reduced diameter on which there is a closed annular array of pieces each of which has surfaces slidably engaged with surfaces of two immediately adjacent pieces to allow the array to expand radially while remaining closed without any gap arising between the engaged surfaces and the pieces being arranged so that the engaged surfaces are forced together by the applied load.

Forms of apparatus will now be described by way of example to illustrate the invention with reference to the accompanying drawings in which:

DETAILED DESCRIPTION OF PREFERRED EMBODIMENTS

Figure 1:
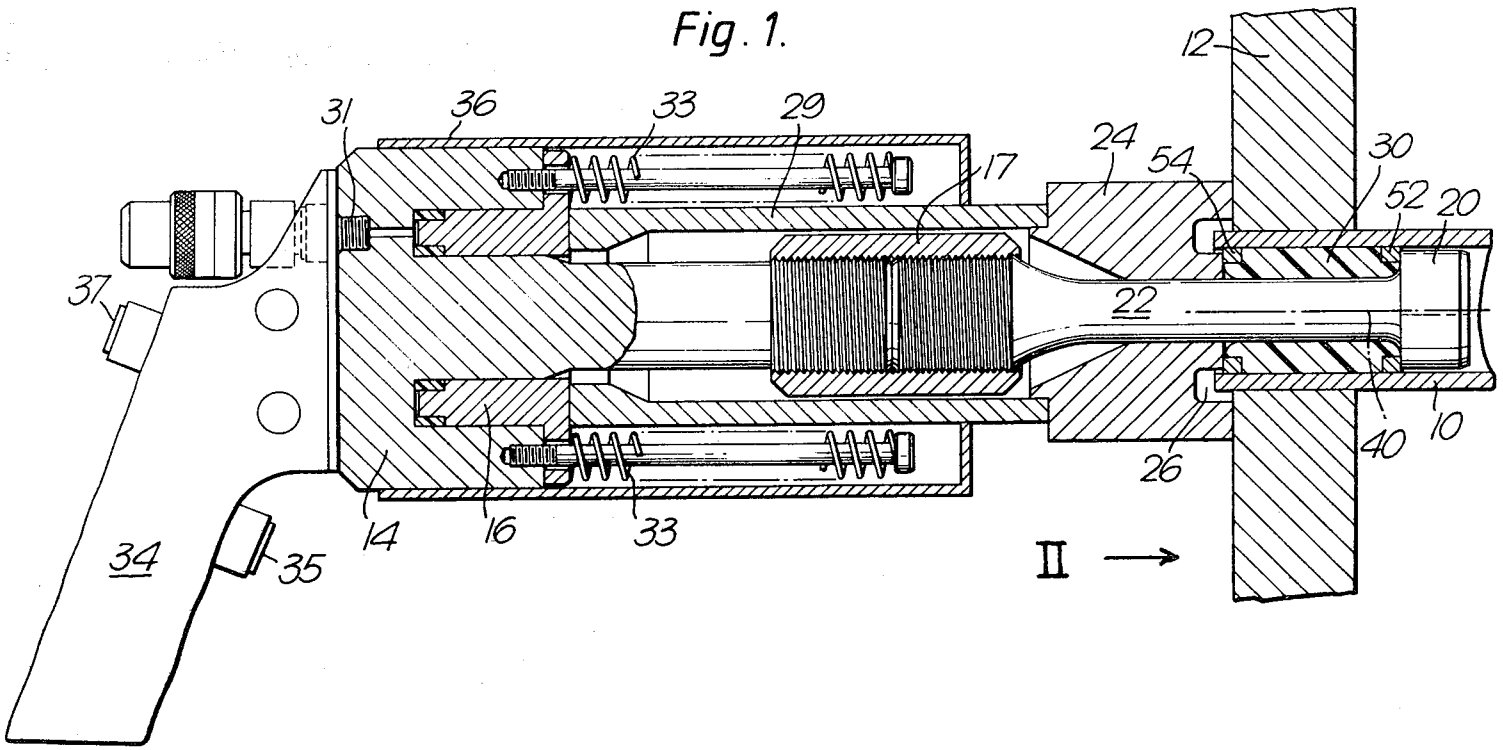
FIG. 1 is a longitudinal section through one form of apparatus.
Figure 2:
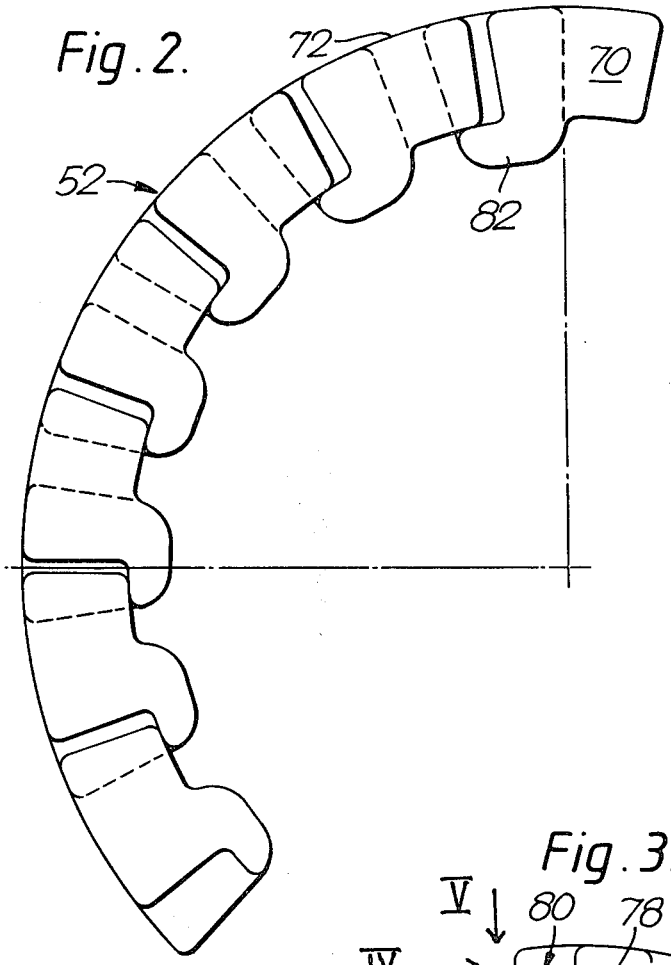
FIG. 2 is an elevation as seen in the direction of the arrow II in FIG. 1 of part of the righthand array of pieces shown in the apparatus in FIG. 1.
Figure 3:
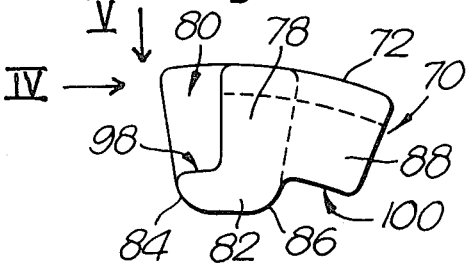
FIGS. 3, 4 and 5 are respectively an elevation, an end elevation as seen in the direction of arrow IV in FIG. 3 and a plan as seen in the direction of the arrow V in FIG. 3 of one of the pieces shown in FIG. 2.
Figure 4:
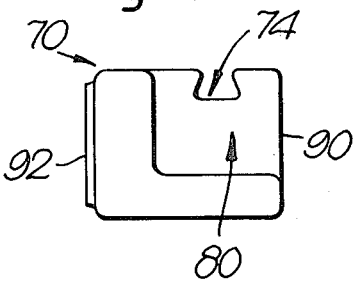
Figure 5:
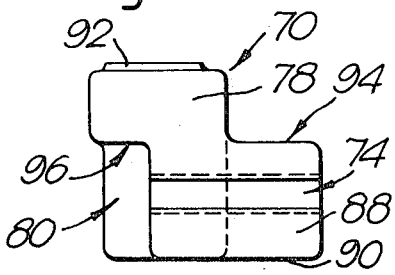

FIG. 1 shows apparatus positioned ready to expand a steel tube 10 in an aperture in a tubeplate in the form of a wall 12 of a steel boiler drum.

The apparatus consists of the following main parts: a hydraulic assembly including an annular cylinder 14 containing an annular piston 16; a head 20 integrally formed on a shaft 22 connected to the cylinder 14 by a screwed sleeve 17; the shaft 22 extending through an annular collar 24 which is in two separable halves and which has an annular groove 26 to accommodate the end of the tube 10; and an annular cylindrical body 30 of elastomeric material which in this case is polyurethane of 80° Shore A hardness. A tubular spacer 29 is interposed between the piston 16 and the collar 24. Return springs 33 are provided compressible upon leftward motion (as seen in FIG. 1) of the cylinder 14 relative to the piston 16. The springs 33 extend upon release of hydraulic pressure to return the cylinder to the position shown.

The apparatus is portable and is designed for use within restricted closed spaces, for example within boiler drums. The apparatus has two handles, one of which is shown at 34. The other handle is not shown but may extend from the side or the top of the cylindrical housing 36 which is secured to the cylinder 14. Buttons 35, 37 operate switches to control operation of the apparatus.

The hydraulic cylinder 14 is connected at 31 to a source of pressurised hydraulic fluid (not shown) by which the cylinder 14 can be forced leftward from the position shown in FIG. 1 apply a load parallel to the central longitudinal axis 40 of the body 30 and of the apparatus, so as to compress the body 30 axially. This causes the body 30 to expand radially to apply pressure to the tube 10 so as to stress both it and the wall 12 beyond their elastic limits.

Preferably, pressures up to 70,000 pounds per square inch (4830 bar) (dependent on the properties of the wall 12) are exerted on the tube 10 so as to ensure that the elastic limit is exceeded in an annular zone of the wall 12 around the tube having a diameter some 1.7 times the diameter of the aperture in which the tube 10 is located. This ensures maximum residual stress in the wall 12 so that the gripping load on the tube 10 when the applied load is removed is at or near the maximum possible.

The applied loads required to achieve such stresses in boiler materials are very high. Typically, the materials are mild steel suitable for riser and take-off tubes in water tube boilers of up to four inches outside diameter; for mild steel fire tubes of one inch (25.4 mm) and 1.5 inch (38.1 mm) outside diameter for fire tube boilers; and other similar applications.

For example, where the tube 10 is of 2 inches outside diameter (50.8 millimeters) and of wall thickness 0.205 inch (5.2 mm) and where the wall 12 is 1.5 inches thick (38.1 mm), the pressure applied to the tube is for example 65,000 psi (4483 bar).

The forming of the head 20 and shaft 22 in one piece avoids high stress concentrations which would occur if a detachable head were used.

At such pressures the polyurethane body 30 tends to extrude past the containment represented by the head 20 and the collar 24. The radial clearance between the head 20 and the inside surface of the tube 10 may be as high as 0.1 inch (2.54 mm) because of tolerances on the tube dimensions typical of boiler tube stock.

The invention prevents such extrusion or at least restricts it to an acceptably low amount. This is achieved by the provision of annular expansible supports 52, 54 at the ends of the body 30.

Each support 52 or 54 consists of an annular array of metal pieces 70 (see FIGS. 2 to 5).

Each piece 70 is of cast hard steel, such as type EN-6, for example, and is made by a lost-wax casting process. Each piece 70 is generally segment shaped and has a convex radially outer surface 72 in which there opens a dove-tail section groove 74. Each piece 70 has an end portion 78 of relatively greater thickness (as seen best in FIG. 5) which includes a recess 80 and a radially inwardly directed projection 82 which is radiussed at 84 and 86.

The recess 80 can accommodate the relatively thinner end portion 88 of an adjacent piece 70 in the array 52 so that the plain faces 90 of the array of pieces 70 are co-planar. The faces 90 engage the head 20 shown in FIG. 1. The other array 54 of pieces is similar and the corresponding faces 90 in the array 54 engage the collar 24.

The portion 78 of each piece 70 has a plateau 92 which the remainder of a connection between the piece and a sprue (not shown) which connection is formed during the casting of the piece 70. The connection is severed after the piece 70 is cast, leaving the plateau 92.

Each piece 70 in the arrays 52 and 54 engage the body 30 at that side remote from the face 90.

The body 30 has at each end an end portion of reduced diameter in the form of a spigot 56 on which an array 52 or 54 is positioned.

The pieces 70 are interconnected by a continuous band of rubber (not shown) located in the grooves 74 in each array. The band allows the array to expand and contract.

The body 30 is shaped so that parts of the body occupy regions between the pieces 70 in the arrays 52 and 54, which regions would otherwise be empty gaps. The occupation of those regions by parts of the body 30 assists the array in properly supporting the body during compression.

The surfaces 94 and 96 of each piece 70 are slidably engaged with the corresponding surfaces of adjacent pieces 70 and such surfaces of the pieces in the array are forced together by the applied load.

The surfaces 98 and 100 of each piece 70 are slidably engaged with the corresponding surfaces of adjacent pieces 70 and such surfaces of the pieces in the array are forced together by the applied load.

The arcuate surfaces 72 of the pieces 70 in the array are forced by the applied load into engagement with the inner surface of the tube 10. However, because of tolerances on the inner diameter of the tube 10 being expanded and the change in diameter as it expands the radius of curvature of the surfaces 72 must in general be different from the radius of curvature of the inner surface of the tube 10. The surfaces 72 however effectively present an envelope surface which is a very close approximation to the inner surface of the tube 10. The radius of curvature of the surface 72 is chosen so that the radius is equal to or slightly less than the radius of curvature of the inner surface of the tube 10 at all stages of use of the apparatus. Thus, in its unexpanded condition the radius of curvature of the surfaces 72 is preferably equal to (but in practice may be less than) the overall radius of the array 52 or 54.

Each piece 70 can thus rock very slightly on its surface 72 to take up a position corresponding to the effect of the applied load in forcing the surfaces 98 and 100 at opposite ends of the piece 70 into engagement with the corresponding surfaces of adjacent pieces 70.

Since the pieces engage one another at all times, the array is always closed.

Figure 6:
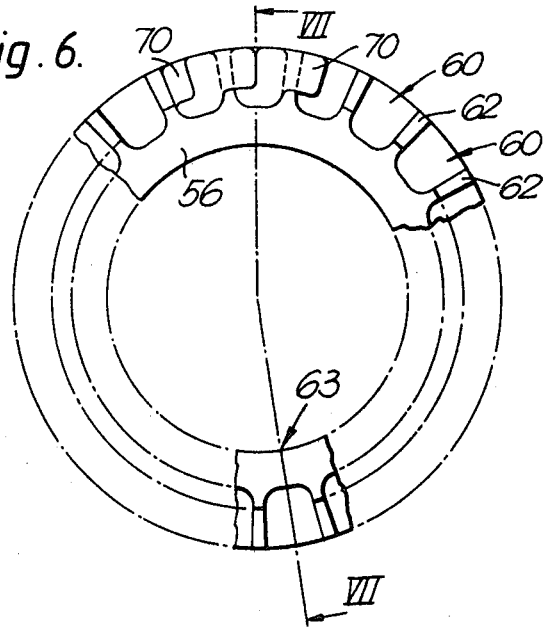
FIGS. 6 and 7 are respectively an end elevation of, and a section on the line VII—VII in FIG. 6 through, one half of a body of elastomeric material to be used in the apparatus shown in FIG. 1.
Figure 7:
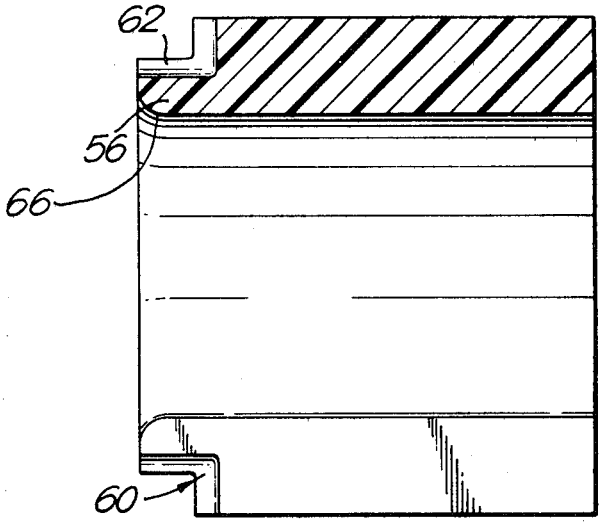

The body 30 is made up of two identical halves placed back to back. One such half is shown in FIGS. 6 and 7. Each such half has an end portion or spigot 56 of reduced diameter, on which a support 52 or 54 is arranged, and the half body is split at 63 to facilitate assembly on the shaft 22, after which the ends at 63 are cemented together.

Each half of the body is made by placing the respective array of pieces 70 in a mould in correct position to form a support 52 or 54 and casting polyurethane around the pieces to give the shape shown, which of course conforms closely to the pieces 70 when they are arranged around the reduced diameter part 56. Two such pieces 70 are shown in FIG. 6 representing the assembly of the pieces 70 onto the body half.

As can be seen in FIGS. 6 and 7, the body half has moulded alcoves 60 which are generally L-shaped as seen in FIG. 7 and which extend both radially in the full diameter part of the body and longitudinally on the reduced diameter portion 56. The alcoves 60 are separated by L-shaped walls 62. The projection 82 of each piece 70 is accommodated in the base of an alcove 60 and the remainder of the piece occupies part of that same alcove 60 and part of an adjacent alcove 60, each piece 70 extending across the L-shaped wall 62 between those adjacent alcoves 60.

Each L-shaped wall 62 occupies the region between two adjacent pieces 70.

Each half body is moulded so as to have a radiussed edge at 66 to conform with the radius at the join of the head 20 and the shaft 22 (FIG. 1).

FIGS. 6 and 7 show seven pieces of a typical total of eighteen pieces, for example. In that case the outside diameter of the array in its contracted condition would be 1.846 inch (46.9 millimeters). In other arrangements, using identical pieces or pieces of the same shape as the pieces 70 but of different dimensions the body halves may be moulded around sixteen, nineteen, twenty, or twenty-eight pieces; or around some other number of pieces depending on the size of the tube to be expanded.

When the hydraulic fluid is fed under pressure into the cylinder 14, the latter moves leftward from the position shown in FIG. 1. The collar 24 remains in the position shown abutting the plate 12, so that the support 54 also remains in the position shown. The movement of the cylinder 14 forces the head 20 and the support 52 to the left from their positions shown, so that the body 30 is compressed. This forces the closed annular supports 52 and 54 to expand radially, so that the pieces 70 are forced into tight engagement with the tube 10. The arrays expand to outer diameters greater than the diameters of the head 20 or of the part of the collar 24 within the tube 10.

There are no empty gaps between the pieces 70 into which the body 30 can extrude. The L-shaped walls 62 fully occupy the regions between the pieces at all times and so the body is given maximum support.

Figure 12:
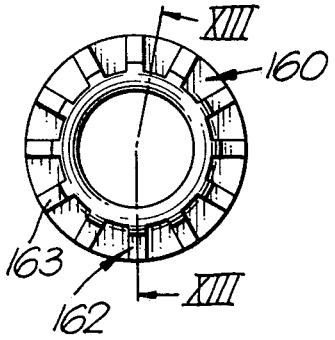
FIGS. 12 and 13 are respectively an end elevation of, and a section on the line XIII—XIII in FIG. 12 through one half of a body of elastomeric material to be used with that modified array in the apparatus shown in FIG. 1.
Figure 13:
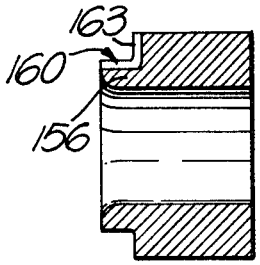

A modified support is shown in FIGS. 8 to 11 in which the support is made up of two kinds of pieces. Such pieces are used with a slightly modified body 30 one of the two halves of which is shown in FIGS. 12 and 13.

Figure 8:
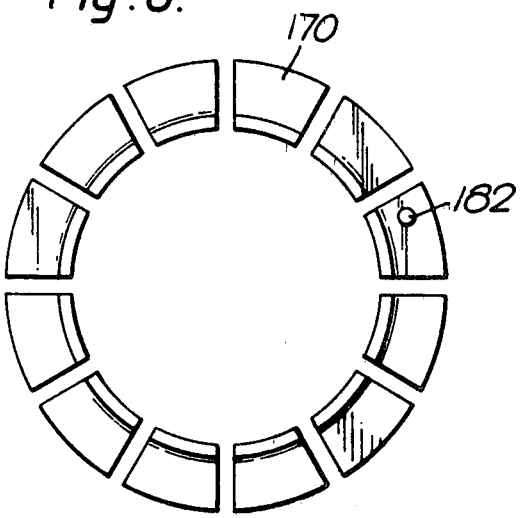
FIGS. 8 and 9 are respectively a front elevation of and a diametral section through a first kind of pieces to be used in a modified array of pieces in the apparatus shown in FIG. 1.
Figure 9:
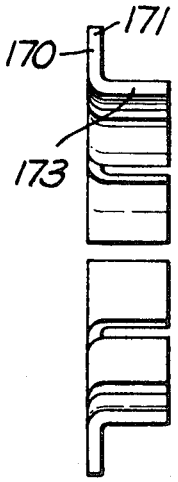

The first kind is segmental and L-shaped as shown at 170 in FIGS. 8 and 9. The pieces 170 are made by sawing an L-section ring into twelve equal pieces and they are located in L-shaped alcoves 160 (similar in certain respects to the recesses 60 described above) in the body 30 (which is modified accordingly, see FIGS. 12 and 13) so that each piece 170 has a first limb 171 extending radially with respect to the central longitudinal axis of the shaft 22, the end of the limb 171 being flush with the outer cylindrical surface of the body 30 and its second limb 173 extends parallel to that axis and the end of the limb 173 is flush with an end surface of the body 30.

As in the embodiment first described, there are no empty gaps between the pieces 170 into which the body 30 can extrude. The L-shaped ribs 163 which separate the alcoves 160 are present from the outset and fully occupying the regions between the pieces 170.

Figure 10:
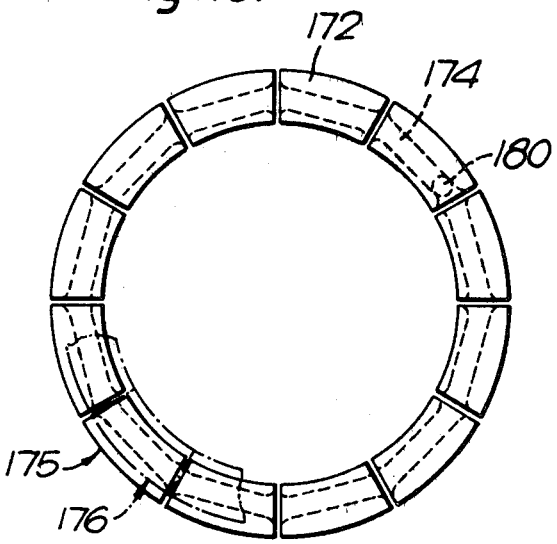
FIGS. 10 and 11 are respectively a front elevation of and a diametral section through a second kind of pieces to be used in that modified array of pieces.
Figure 11:
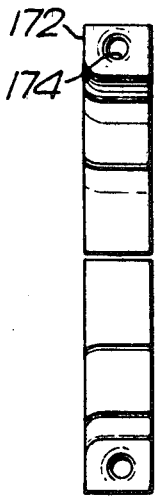

The second kind of piece is also segment-shaped as shown at 172 in FIGS. 10 and 11.

Each piece 172 has a through-passage 174. The pieces 172 are made by sawing through a machined ring (indicated at 175) to make twelve segments and so that after sawing the segments fit together to form a ring of a smaller diameter indicated by the ghost outline 176. The segments 172 are mounted on an elastic band (not shown) running through the passages 174.

In the array 52 or 54, the pieces 172 are positioned around the limbs of the L-shaped pieces 170 which extend parallel to the shaft 22. Each piece 172 has two surfaces in slidable engagement at one end with two surfaces of one immediately adjacent piece 170 and in slidable engagement at the other end with two surfaces of another immediately adjacent piece 170. The complete annular array of pieces 170 and 172 is always closed but is able to expand radially when the body 30 is axially compressed so as to ensure that, as the tube 10 expands, no gap arises through which the material of the body 30 can extrude. The radially extending limbs of the pieces 170 bridge the radial gaps between the pieces 172 and there is a hole 180 in one segment 172 (FIG. 10) to receive a pin 182 mounted on one piece 170 (FIG. 8) to ensure the required staggered relationship between the two kinds of piece, each of which is of hardened steel. The slidably engaged surfaces are forced together by the applied load. The pieces 170 and 172 are also forced against the head 20 or the collar 24 but are slidable relatively thereto. The pieces 170 and 172 are forced against the tube 10 too so that the body 30 is fully supported and cannot extrude past the head 20 or the collar 24.

As before, the body 30 in this modification is made up of two identical halves placed back to back. One such half is shown in FIGS. 12 and 13. Each such half has an end portion 156 of reduced diameter, on which a support 52 or 54 is arranged, and the half body is split at 162 to facilitate assembly on the shaft, after which the ends at 162 are cemented together.

When the body 30 is axially compressed the elastomeric material in the portion 156 at each end expands radially and forces the closed annular support 52 or 54 to expand radially too, so that the pieces 170 and 172 are forced into tight engagement with the tube 10 as already mentioned. The arrays expand to outer diameters greater than the diameters of the head 20 or of the part of the collar 24 within the tube 10 but unoccupied gaps between the pieces in the arrays do not arise.

The parts of the ribs 163 between the radial limbs 171 of the pieces 170 are pressed against the inner surface of the tube 10 and against the pieces 172.

The parts of the ribs 163 between the limbs 173 of the pieces 170 are pressed against the pieces 172 and against the inner surface of either the head 20 or of the collar 24. In both cases those parts of the ribs 163 are positioned some way radially inwardly from the periphery of the head 20 or the collar 24, so that even when the tube 10 is fully expanded those parts of the body 30 are still fully supported by the head 20 or the collar 24 when the operating load is applied.

The halves of the body 30 are preferably cast about the pieces 170 of the respective array in a manner similar to that described above with reference to FIGS. 2 to 7.

Figure 14:
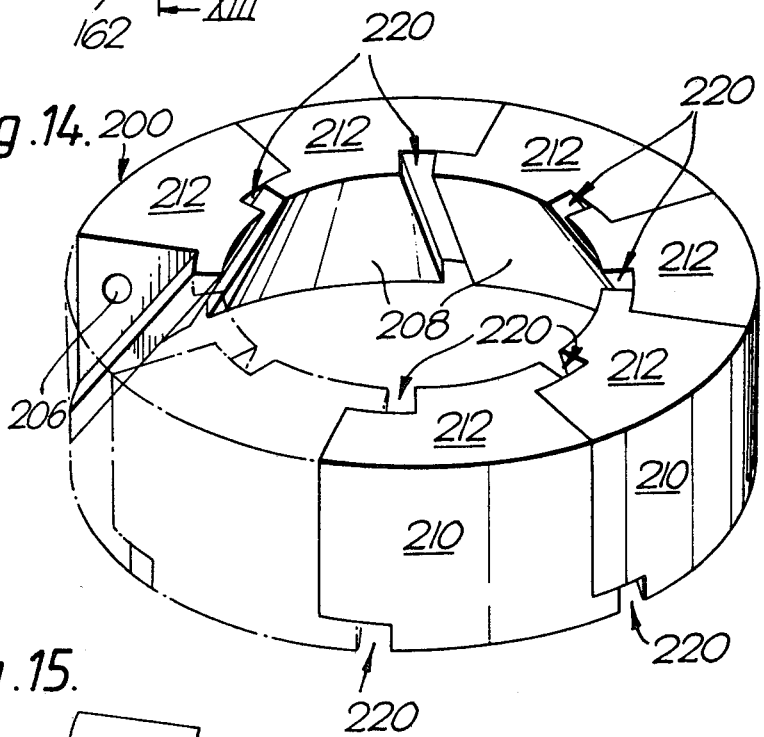
FIGS. 14 and 15 are isometric views showing yet another modified array of pieces.
Figure 15:
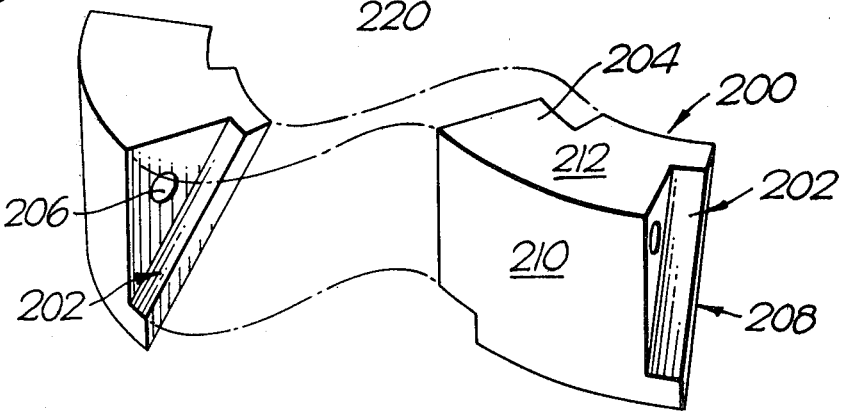

FIGS. 14 and 15 show yet another form of support in which there is an array of eight pieces 200 of only one kind. Each piece is of approximately triangular parallelepiped form but is preferably slightly curvilinear especially at its outer surfaces to conform with the tube inner surface.

Each piece 200 has a triangular parallelepiped recess 202 at one end and a correspondingly shaped triangular parallelepiped projection 204 at the other end. The pieces 200 have through-passages 206 to receive a retaining elastic band (not shown).

The pieces 200 are intended for mounting on a reduced diameter portion of a body similar to the body 30 but the reduced diameter portion would be frusto-conical to match the frusto-conical surface envelope represented by the inner inclined faces 208 of the pieces 200. Preferably, the frusto-conical surface is a surface of revolution of a rectilinear generator inclined preferably at 45° to the central longitudinal axis of the body 30.

The outer faces 210 of the pieces 200 would be flush with the outer cylindrical surface of the body and the faces 212 of the pieces 200 would be flush with an end surface of the body.

The material of the body 30 would occupy fully the regions at 220 between the pieces 200 so that there are no gaps into which material can extrude at the outer periphery of the support. The body 30 is preferably cast as before.

The inclined surfaces of the projections 204 and recesses 202 are preferably at 45° to the central longitudinal axis of the body 30 and are slidably engaged to allow the array to expand radially and those surfaces are forced together by the applied load so that no gap arises between them.

In a modification (not shown), the surfaces 208 and the corresponding part of the body 30 may be part spherical or part of another surface of revolution of a curvilinear generator rotated about the central longitudinal axis of the body 30.

In another modification (not shown) the inclined surfaces of the projections 204 and the recesses 202 may be partly frusto-conical (preferably generated by a rectilinear generator inclined at 45° to the central longitudinal axis of the body 30), partly spherical or part of another surface of revolution of an arcuate generator rotated about the central longitudinal axis of the body 30.

In general the arrays 52, 54 will be similar or identical. However, the invention includes apparatus in which one array is of one construction and the other is of different construction.

In the body 30 described above with reference to FIGS. 6 and 7 each half body may have the following dimensions in the several examples given. In each case the dimensions relate to the unstressed half body:

| Tube Outside diameter | Tube Wall | Length | Outside diameter | Inside diameter |
|---|---|---|---|---|
| 57 mm | 9 Gauge | 45.8 mm | 49.7 mm | 29.9 mm |
| 57 mm | 7 Gauge | 45.8 mm | 47.7 mm | 29.9 mm |
| 50.8 mm | 4 Gauge | 45.9 mm | 38.3 mm | 23.0 mm |
| 76.1 mm | 7 Gauge | 45.8 mm | 67.4 mm | 49.6 mm |

In each case each alcove 60 extended some 7.9 mm back from the end of the half body, (corresponding to the thicker end portion of the piece 70) and had a maximum radial depth of 12.7 mm. Each radial limb of the walls 62 was 2.4 mm deep in the axial direction of the body 30 and each axial limb of the walls 62 was 2.0 mm deep in the radial direction.

Reference is made to a concurrently filed application, Ser. No. 227,359, which claims the method of expanding tubular members as described herein.

What is claimed is:

1. Apparatus for expanding tubular members comprising an annular body of elastomeric material, means operable to apply a load to said body parallel to the central longitudinal axis thereof to compress said body and to expand same radially against one said tubular member, said body comprising end portions of reduced diameter, said apparatus further comprising two support means, respectively arranged about said end portions, each said support means comprising a closed annular array of pieces, each said piece having surfaces which slidably engage respective surfaces of adjacent pieces to allow the respective array to expand radially while remaining closed without any gap arising between said engaged surfaces, said pieces being arranged so that said engaged surfaces are forced together by said load.

2. Apparatus according to claim 1, in which said surfaces are presented respectively by an end portion of the piece and a wall of a recess in said piece, each said recess of each piece receiving one said end portion of an adjacent piece.

3. Apparatus according to claim 2, in which each said recess has a further wall presenting a further surface engaged by a corresponding surface of said end portion of said adjacent piece.

4. Apparatus according to claim 2, in which said surfaces comprise surfaces which extend normally to said longitudinal axis.

5. Apparatus according to claim 2, in which said surfaces comprise surfaces which are inclined to said longitudinal axis.

6. Apparatus for expanding tubular members comprising an annular body of elastomeric material, means operable to apply a load to said body to compress said body axially thereof and to expand same radially against one said tubular member, said body comprising end spigots of reduced diameter, and said body being shaped to provide at each end thereof alcoves spaced apart around said longitudinal axis, each said alcove being partly in said spigot and partly in an adjacent full diameter zone of said body, said body also comprising spaced apart L-shaped ribs each having a limb extending parallel to said longitudinal axis and forming part of said spigot, said ribs separating said alcoves, said apparatus further comprising two support means respectively arranged about said end portions, each said support means comprising a closed annular array of pieces, each said piece having an end portion of relatively greater thickness in a sense parallel to said axis, which said end portion has surfaces defining a recess and is received in a respective one of said alcoves and each said piece having a relatively thinner opposite end portion which extends across a respective one of said L-shaped ribs and which is received in a respective recess of an adjacent piece, each said piece having first and second surfaces bounding said recess and said relatively thinner end portion respectively which respectively slidably engage second and first surfaces of adjacent pieces to allow the respective array to expand radially while remaining closed without any gap arising between said engaged first and second surfaces, said pieces being arranged so that said engaged first and second surfaces are forced together by said load.

7. Apparatus for expanding tubular members comprising an annular body of elastomeric material, means operable to apply a load to said body to compress said body axially thereof and to expand same radially against one said tubular member, said body comprising end portions of reduced diameter, said apparatus further comprising two support means respectively arranged about said end portions, each said support means comprising a closed annular array of pieces, each said piece having surfaces which slidably engage respective surfaces of adjacent pieces to allow the respective array to expand radially while remaining closed without any gap arising between said engaged surfaces, said pieces being arranged so that said engaged surfaces are forced together by said load, said body being shaped so as to fit closely against said arrays.

8. Apparatus according to claim 7, in which said body is shaped by casting in contact with an array.

9. Apparatus for expanding tubular members comprising an annular body of elastomeric material, means operable to apply a load to said body to compress said body axially thereof and to expand same radially against one said tubular member, said body comprising end portions of reduced diameter, said apparatus further comprising two support means respectively arranged about said end portions, each said support means comprising a closed annular array of pieces, each said array comprising first type L-shaped pieces and second type pieces, said body having surfaces defining L-shaped alcoves receiving respective ones of said first type pieces, each said first type piece having a first limb extending parallel to said axis and presenting a first outwardly facing surface and having a second limb extending radially outwardly and presenting a second surface facing towards the adjacent end of said body, each said second type piece having corresponding surfaces respectively slidably engaging said first and second surfaces to allow the respective array to expand radially while remaining closed without any gap arising between said engaged surfaces, said pieces being arranged so that said engaged surfaces are forced together by said load.

* * * * *